US007091934B2

(12) United States Patent
Kim et al.

(10) Patent No.: US 7,091,934 B2
(45) **Date of Patent: *Aug. 15, 2006**

(54) METHOD AND APPARATUS FOR CONTROLLING ADDRESS POWER FOR A PLASMA DISPLAY PANEL

(75) Inventors: Woo-Jin Kim, Ahsan (KR); Yoon-Phil Eo, Yongin (KR); Young-Chan Lee, Bucheon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 424 days.

This patent is subject to a terminal disclaimer.

(21) Appl. No.: 10/628,739

(22) Filed: Jul. 28, 2003

(65) Prior Publication Data

US 2004/0021621 A1 Feb. 5, 2004

(30) Foreign Application Priority Data

Jul. 30, 2002 (KR) ..... 10-2002-0044802

(51) Int. Cl.
*G09G 3/28* (2006.01)

(52) U.S. Cl. ..... 345/60; 345/211

(58) Field of Classification Search ..... 345/60–71, 345/211

See application file for complete search history.

(56) References Cited

U.S. PATENT DOCUMENTS 6,177,914 B1 * 1/2001 Iwama et al. ..... 345/60
6,680,717 B1 * 1/2004 Tanaka ..... 345/60

FOREIGN PATENT DOCUMENTS

JP 2001-109420 4/2001

* cited by examiner

*Primary Examiner*—Dennis-Doon Chow
(74) *Attorney, Agent, or Firm*—Christie, Parker & Hale, LLP

(57) ABSTRACT

A method and apparatus for controlling address power of a plasma display panel and a plasma display panel device having that apparatus, wherein the plasma display panel includes pluralities of address electrodes, scan electrodes, and sustain electrodes, the scan electrodes and sustain electrodes forming pairs and being alternately disposed. After determining an attenuation coefficient that corresponds to a sum of pixel differences between lines throughout an input video signal, output video data is modified by multiplying the attenuation coefficient to the input video data. According to such a power control of address data, power consumption is reduced since the number of times of switching address data is reduced.

11 Claims, 4 Drawing Sheets

20

| | | | | | | | |
|---|---|---|---|---|---|---|---|
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |
| 0 | 1 | 0 | 1 | 0 | 1 | 0 | 1 |
| 1 | 0 | 1 | 0 | 1 | 0 | 1 | 0 |

METHOD AND APPARATUS FOR CONTROLLING ADDRESS POWER FOR A PLASMA DISPLAY PANEL

CROSS REFERENCE TO RELATED APPLICATION

This application claims priority to and the benefit of Korea Patent Application No. 2002-0044802 filed on Jul. 30, 2002 in the Korean Intellectual Property Office, the entire disclosure of which is incorporated herein by reference.

FIELD OF THE INVENTION

The present invention relates to a plasma display panel (PDP) device, and more particularly, to a method and apparatus for controlling address power of a PDP, and a PDP device having that apparatus.

BACKGROUND OF THE INVENTION

Usually, a PDP shows high power consumption due to its driving characteristics. Therefore, control of its power consumption is needed according to a required load of a displayed frame. For the control of the power consumption, a power level is automatically controlled to remain under a limit.

According to the prior art, such automatic power control is only applied to a power source regarding generation of sustain pulses but not to a power source regarding generation of address data. Accordingly, power consumption regarding generation of address data has remained at a high level.

FIG. 1 illustrates image data in a full-white state. In a full-white state where every image data segment will have the value of "1", almost no fluctuation in data is introduced throughout address electrodes, and pulse switching also remains at its minimum. In addition, charging/discharging reactive power also remains small since power consumption proportionally increases with the number of times of switching. A driving signal for such a full-white state may have a waveform as shown in FIG. 2. As shown in FIG. 2, in a full-white state, it is only required to switch once for column 10 in FIG. 1.

However, image data can be of a dot-pattern as illustrated in FIG. 3 wherein image data repeatedly alternates between 1 and 0. Accordingly, a significant amout of switching is required, for example, for column 20. A corresponding driving signal may have a waveform shown in FIG. 4. As shown in FIG. 4, in a dot-pattern, data fluctuation and pulse switching will occur. As a result, power consumption increases.

As can be seen from the above description, power consumption increases as the number of different pixels between a previous line and a current line increases and also because of the increase in switching.

SUMMARY OF THE INVENTION

In accordance with the present invention a method and apparatus is provided for controlling address power of a PDP and a PDP device that can reduce power consumption by reducing the number of times of switching address data. In particular, a method is provided for controlling address power of a PDP that includes pluralities of address electrodes, scan electrodes, and sustain electrodes, the scan electrodes and sustain electrodes forming pairs and being alternately disposed. The method includes: calculating a sum of pixel differences between lines throughout an input video signal; determining an attenuation coefficient that corresponds to the calculated sum; and outputting video data modified by multiplying the video signal with the attenuation coefficient.

Further in accordance with the present invention an apparatus is also provided for controlling address power of a PDP that includes pluralities of address electrodes, scan electrodes, and sustain electrodes, the scan electrodes and sustain electrodes forming pairs and being alternately disposed. The apparatus includes: a memory for storing sustain discharging information with respect to load ratios; an address power controller for calculating a sum of pixel differences between lines of an externally input video signal and for outputting video data modified by multiplying the video signal with an attenuation coefficient corresponding to the calculated sum; and a video data processor for processing the modified video data; an average signal lever detector for measuring a load ratio of the video data modified; and a sustain power controller for outputting sustain discharge information corresponding to a load ratio of currently input data.

In one embodiment the video data processor transforms the modified video data signal to a data signal for gray control, and, classifying the data signal according to its gray scale, outputs the classified data signal in an order corresponding to a predetermined driving sequence.

Also in accordance with the present invention a PDP device is provided including: a PDP that has pluralities of address electrodes, scan electrodes, and sustain electrodes, the scan electrodes and the sustain electrodes forming pairs and being alternately disposed; a controller for calculating a sum of pixel differences between lines of the video signal, outputting video data modified by multiplying the video signal with an attenuation coefficient corresponding to the calculated sum, measuring a load ratio of the video signal, and outputting sustain discharge pulse information corresponding to the measured load ratio; an address data generator for generating address data corresponding to the modified data received from the controller, and for accordingly applying the address data to the address electrodes of the PDP; and a sustain-scan pulse generator for generating sustain pulses and scan pulses corresponding to sustain discharge information received from the controller, and for respectively applying the sustain pulses and the scan pulses to the sustain electrodes and the scan electrodes.

DETAILED DESCRIPTION

Figure 1:
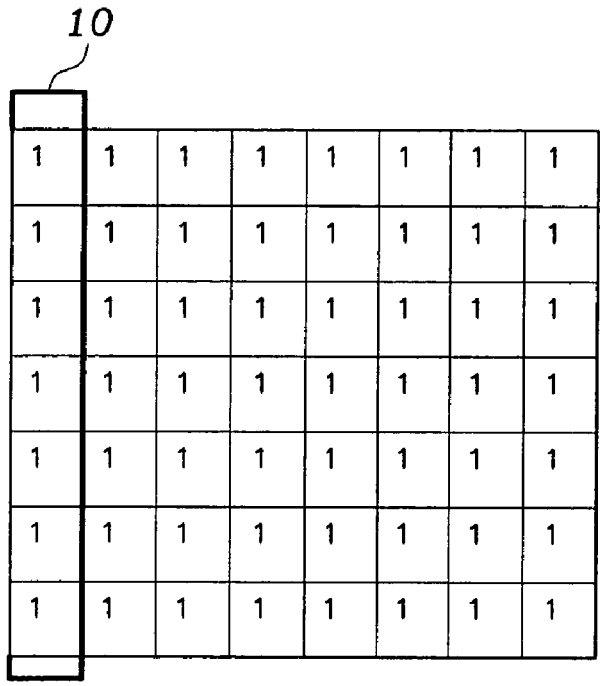
FIG. 1 illustrates image data in a full-white state.
Figure 2:
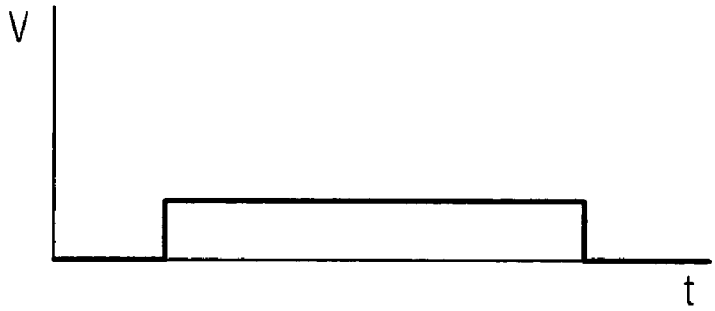
FIG. 2 illustrates a switching diagram related to FIG. 1.
Figures 3, 4:
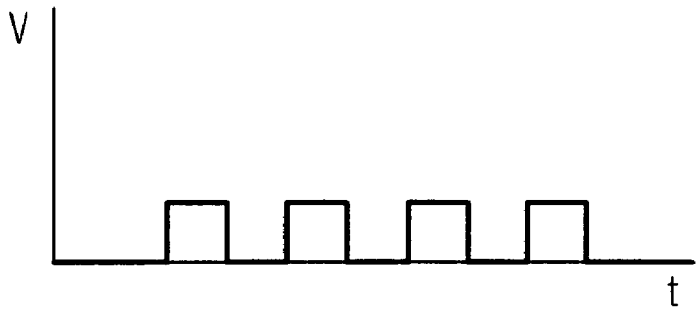
FIG. 3 illustrates image data of a dot-pattern.
FIG. 4 illustrates a switching diagram related to FIG. 3.
Figure 5:
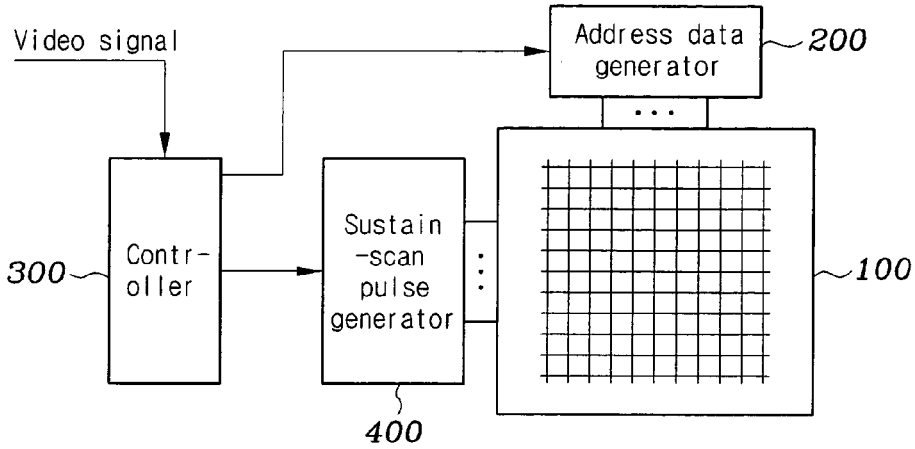
FIG. 5 is a schematic diagram of a PDP device according to an embodiment of the present invention.

FIG. 5 is a schematic diagram of a PDP device according to an embodiment of the present invention. As shown in FIG. 5, a PDP device includes PDP100, controller 300, address data generator 200, and sustain-scan pulse generator 400.

PDP 100 includes pluralities of address electrodes, scan electrodes, and sustain electrodes. The scan electrodes and the sustain electrodes are alternately disposed forming pairs.

Controller 300 calculates a sum of pixel differences between lines of the video signal and outputs video data modified by multiplying the video signal with an attenuation coefficient corresponding to the calculated sum.

Controller 300 also measures a load ratio of the video signal, and outputs sustain discharge pulse information corresponding to the measured load ratio.

Address data generator 200 generates address data corresponding to the modified data received from controller 300, and accordingly applies the address data to the address electrodes of the PDP.

Sustain-scan pulse generator 400 generates sustain pulses and scan pulses corresponding to sustain discharge information received from controller 300, and respectively applies the sustain pulses and the scan pulses to the sustain electrodes and the scan electrodes.

Figure 6:
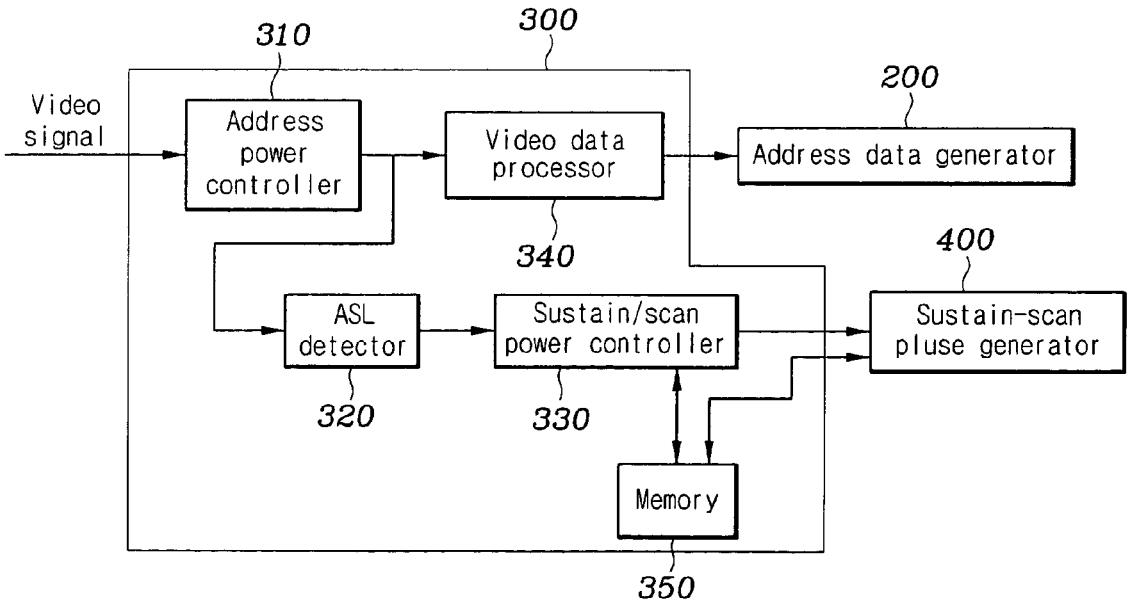
FIG. 6 is a block diagram for a detailed structure of the controller shown in FIG. 5.

FIG. 6 shows a more detailed structure of controller 300 shown in FIG. 5.

As shown in FIG. 6, controller 300 includes address power controller 310, video data processor 340, sustain power controller 330, average signal level (ASL) detector 320, and memory 350.

Memory 350 stores sustain discharging information with respect to load ratios.

Address power controller 310 calculates a sum of pixel differences between lines throughout an external input video signal, and outputs video data modified by multiplying the video signal with an attenuation coefficient corresponding to the calculated sum.

Video data processor 340 transforms the modified video data signal to a data signal for gray control, and classifies the data signal according to its gray scale. Subsequently, video data processor 340 outputs the classified data signal in an order corresponding to a predetermined driving sequence.

ASL detector 320 measures a load ratio of the video data modified.

Sustain power controller 330 outputs sustain discharge information corresponding to a load ratio of currently input data.

Operations of a method and apparatus for controlling address power of a PDP according to an embodiment of the present invention, and a PDP device having that apparatus are hereinafter described in detail with reference to FIGS. 5 to 7.

Figure 7:
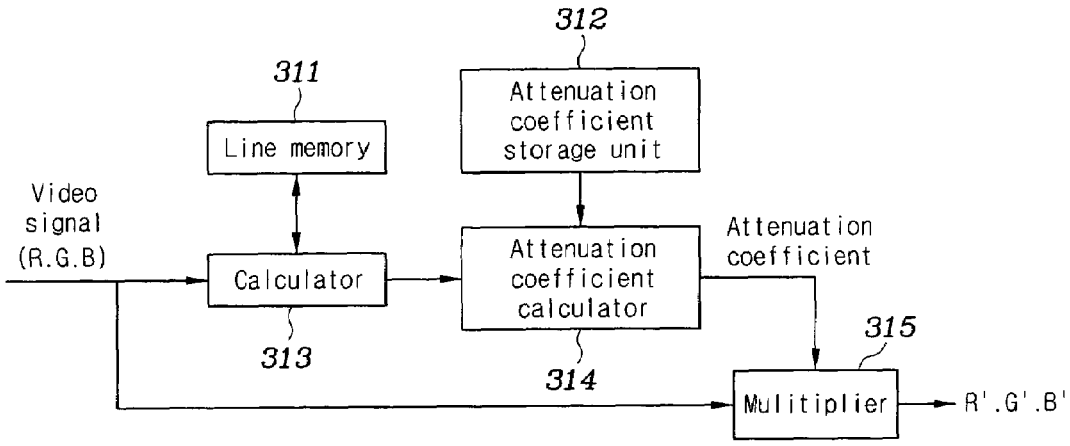
FIG. 7 is a block diagram for a detailed structure of the address power controller shown in FIG. 6.

FIG. 7 shows a detailed structure of address power controller 310 shown in FIG. 6. First, an external video signal is input to controller 300. The external video signal includes data components red (R), green (G), and blue (B), and synchronization signals Hsync and Vsync. Then, with respect to each line of the video signal, calculator 313 of address power controller 310 stores the line in line memory 311, calculates a pixel difference between current and previous lines stored in line memory 311, and calculates the sum of pixel differences of a frame by summing the pixel difference.

Calculating the sum of pixel differences of a frame can be formularized as in the following equation 1.

$$S = \sum_{I=1}^{N} \sum_{J=1}^{M} P_{i+1,j} - P_{i,j} \qquad \text{(equation 1)}$$

Here, N, M, P, i, and j respectively denote the number of lines in the frame, the number of columns in the frame, pixel data, index for lines, and index for columns. The form of equation 1 can be altered to a variety of other forms, for example, to a form for calculating the value S line by line, or to a form for calculating the value S over the whole frame at once.

Calculator 313 calculates pixel differences in every pair of adjacent lines, i.e., the previous line and the current line, the current line and a next line, the next line and a line after the next line, . . . , the (N−1)-th line, and the N-th line. Calculator 313 then calculates the value S, the sum of those pixel differences, and outputs the value S to attenuation coefficient calculator 314.

Accordingly, attenuation coefficient calculator 314 retrieves an attenuation coefficient corresponding to the value S from attenuation coefficient storage unit 312, and outputs the retrieved attenuation coefficient.

The attenuation coefficient is inversely proportional to the value S, and has a value in the range of 0 to 1. When the value S is large, it implies that pixel differences are large, and accordingly that power consumption is large. In this case, the pixel difference should be reduced by using the attenuation coefficient.

When the value S is 0, the attenuation coefficient is 1. The attenuation coefficient decreases as the value S increases. Values of the attenuation coefficient can be formalized as a lookup table, which can be experimentally obtained. The attenuation coefficient may have various values under the condition that the original video signal is not deformed, and may be designed to have a value larger than 1.

Subsequently, multiplier 315 outputs data modified by multiplying the video signal with the attenuation coefficient.

Referring back to FIG. 6, video data processor 340 transforms the modified data to a data signal for gray control, and classifies the modified data according to its gray scale. Video data processor 340 then outputs the classified data to address data generator 200 in an order corresponding to a predetermined driving sequence.

Address data generator 200 generates address data corresponding to the video data output from video data processor 340, and applies them to the address electrodes.

In parallel, ASL detector 320 measures the average signal level of the modified data. The measured average signal level is then input to sustain-scan power controller 330.

Subsequently, sustain-scan power controller 330 retrieves from memory 350 sustain discharge information corresponding to the load ratio currently measure at ASL detector 320, and then outputs the sustain discharge information to sustain-scan pulse generator 400.

Having received the sustain discharge information, sustain-scan pulse generator 400 retrieves the number of pulses in sustain discharge corresponding to the load ratio from memory 350. Subsequently, sustain-scan pulse generator 400 generates a sustain pulse and a scan pulse, and respectively applies them to the sustain electrode and scan electrode.

Accordingly, corresponding video data is displayed at PDP 100.

According to the embodiment of the present invention described above, an attenuation coefficient is multiplied to input video data when a pixel difference is large in the input video data. As an example, in the case that input video data has a value of "$00000000_2$" (0 in decimal) at a first row and first column pixel $P_{11}$ and a value of "$11111111_2$" (255 in decimal) at a second row and a first column pixel $P_{21}$, addressing for the first row does not occur (i.e., a switch for applying the addressing field is off) at any subfield, and addressing for the second row occurs (i.e., a switch for applying the addressing field is on) at every subfield. That is, when the scanning is performed from the first row to the second row, the switch for applying the addressing field is switched from off to on for every subfield, providing 8 switching times.

In a case that adjacent pixels $P_{11}$ and $P_{21}$ show a large data difference, an attenuation coefficient (e.g., 4/5) is multiplied to each video data value of pixels $P_{11}$, and $P_{21}$. According to this exemplary case, the video data of the pixel $P_{11}$ remains at "$00000000_2$" (0 in decimal) and video data of the pixel $P_{11}$ becomes "$11001100_2$" (204 in decimal), the number of switching times being reduced to 4.

As seen in connection with the described embodiment of the present invention, when an attenuation coefficient is multiplied with video data in the case where a pixel difference between adjacent pixels is large, the data arrangement is altered to reduce the pixel difference. Therefore, the number of switching times of the address electrodes between charging and discharging, and accordingly power consumption, is reduced.

In addition, the number of light-emitting pixels is also reduced by multiplication of the attenuation coefficient with the original data, which also contributes to attenuation of power consumption.

According to the embodiment of the present invention described above a method and apparatus is provided for controlling address power of a PDP and a PDP device is provided having that apparatus that can reduce power consumption by reducing the number of switching times of address data.

While this invention has been described in connection with practical embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for controlling address power of a plasma display panel, the plasma display panel having pluralities of address electrodes, scan electrodes, and sustain electrodes, the scan electrodes and sustain electrodes forming pairs and being alternately disposed on the plasma display panel, the apparatus comprising:

a memory for storing sustain discharging information with respect to load ratios;

an address power controller responsive to an externally input video signal for calculating a sum of pixel differences between lines of the externally input video signal and for outputting video data modified by multiplying the video signal with an attenuation coefficient corresponding to the calculated sum;

a video data processor for processing the modified video data;

an average signal lever detector for measuring a load ratio of the modified video data; and a sustain power controller for outputting sustain discharge information corresponding to a load ratio of currently input data.

2. The apparatus of claim 1, wherein the address power controller comprises:

a line memory for storing a line of the externally input video signal;

a calculator for calculating a pixel difference between a current line and a previous line stored in the line memory and for calculating the sum of pixel differences by summing the pixel differences;

an attenuation coefficient storage unit for storing attenuation coefficients with respect to sums of pixel differences;

an attenuation coefficient calculator for retrieving an attenuation coefficient corresponding to the calculated sum of pixel differences and for outputting the retrieved attenuation coefficient; and a multiplier for outputting data modified by multiplying the video signal with the attenuation coefficient output from the attenuation coefficient calculator.

3. The apparatus of claim 2, wherein the attenuation coefficient is inversely proportional to the sum of pixel differences in a frame.

4. The apparatus of claim 3, wherein the attenuation coefficient is 1 when the sum of pixel differences in a frame is 0, the attenuation coefficient decreases as the sum of pixel differences increases, and the attenuation coefficient has a value in a range of 0 to 1.

5. The apparatus of claim 3, wherein the sum of pixel differences of a frame is calculated as a value of S in the equation $$S = \sum_{I=1}^{N} \sum_{J=1}^{M} P_{i+1,j} - P_{i,j},$$

where N, M, P, i, and j respectively denote a number of lines in the frame, a number of columns in the frame, pixel data, index for lines, and index for columns.

6. The apparatus of claim 3, wherein the video data processor transforms the modified video data signal to a data signal for gray control, and, classifying the data signal according to its gray scale, outputs a classified data signal in an order corresponding to a predetermined driving sequence.

7. A plasma display panel device comprising:

a plasma display panel having pluralities of address electrodes, scan electrodes, and sustain electrodes, the scan electrodes and the sustain electrodes forming pairs and being alternately disposed;

a controller responsive to an externally input video signal for calculating a sum of pixel differences between lines of the externally input video signal, outputting video data modified by multiplying the externally input video signal with an attenuation coefficient corresponding to the calculated sum, measuring a load ratio of the externally input video signal, and outputting sustain discharge pulse information corresponding to the measured load ratio;

an address data generator for generating address data corresponding to the modified data received from the controller, and for accordingly applying the address data to the address electrodes of the plasma display panel; and a sustain-scan pulse generator for generating sustain pulses and scan pulses corresponding to sustain discharge information received from the controller, and for respectively applying the sustain pulses and the scan pulses to the sustain electrodes and the scan electrodes.

8. The plasma display panel device of claim 7, wherein the controller comprises:

a memory for storing sustain discharging information with respect to load ratios;

an address power controller for calculating a sum of pixel differences between lines of an externally input video signal and for outputting video data modified by multiplying the video signal with an attenuation coefficient corresponding to the calculated sum;

a video data processor for processing the modified video data;

an average signal lever detector for measuring a load ratio of the modified video data; and a sustain power controller for outputting sustain discharge information corresponding to a load ratio of currently input data.

9. The plasma display panel device of claim 8, wherein the attenuation coefficient is inversely proportional to a sum of pixel differences between a previous line and a current line, and has a value in the range of 0 to 1.

10. A method for controlling address power of a plasma display panel, the plasma display panel having pluralities of address electrodes, scan electrodes, and sustain electrodes, the scan electrodes and sustain electrodes forming pairs and being alternately disposed, the method comprising:

calculating a sum of pixel differences between lines throughout an input video signal;

determining an attenuation coefficient that corresponds to the calculated sum;

outputting video data modified by multiplying the video signal with the attenuation coefficient;

transforming the modified video data signal to a data signal for gray control;

classifying the data signal according to its gray scale to provide a classified data signal; and outputting the classified data signal in an order corresponding to a predetermined driving sequence determining sustain discharge information that corresponds to a load ratio of input video data;

applying a sustain pulse and a scan pulse to the sustain electrodes and the scan electrodes, the sustain and scan pulses being generated corresponding to the sustain discharge information; and applying address data to the address electrodes, the address data being generated in the order corresponding to the predetermined driving sequence.

11. The method of claim 10, wherein the attenuation coefficient is inversely proportional to a sum of pixel differences between a previous line and a current line, and has a value in the range of 0 to 1.

* * * * *